US006015060A

United States Patent [19]

Rightenour et al.

[11] Patent Number: 6,015,060

[45] Date of Patent: Jan. 18, 2000

[54] BEVERAGE CONTAINER AND OPENING MEANS

[76] Inventors: Tim Rightenour; David Jordan, both of 2304 Sunny Brook Dr. #106, Nampa, Id. 83686

[21] Appl. No.: 09/092,522

[22] Filed: Jun. 5, 1998

[51] Int. Cl.[7] ..... B65D 17/34

[52] U.S. Cl. ..... 220/269; 81/3.48; 220/212; 220/277; 220/752; 220/906

[58] Field of Search ..... 220/906, 269, 220/270, 752, 277, 284, 212, 661, 676, 713; 81/3.48, 3.49; 215/253

[56] References Cited

U.S. PATENT DOCUMENTS

| | | | |
|---|---|---|---|
| 2,015,271 | 9/1935 | Hosmer | 220/284 |
| 3,014,621 | 12/1961 | Povitz | 220/284 |
| 3,627,168 | 12/1971 | Fraze . | |
| 3,662,914 | 5/1972 | Slade . | |
| 4,576,306 | 3/1986 | Kelsey et al. . | |
| 4,872,597 | 10/1989 | Hanafusa . | |
| 5,011,037 | 4/1991 | Moen et al. . | |
| 5,285,919 | 2/1994 | Recchia . | |
| 5,397,014 | 3/1995 | Aydt . | |
| 5,494,184 | 2/1996 | Noguchi et al. . | |

*Primary Examiner*—Stephen P. Garbe
*Assistant Examiner*—Robin A. Hylton

[57] ABSTRACT

A dual aperture beverage container is disclosed, consisting of a beverage container of traditional cylindrical shape, with a traditional pouring aperture assembly on the top of the container, such as a scored section and a tab. Located along the container side wall is a second scored portion. A venting aperture opener is included which hooks onto the top container rim and opens the venting scored portion to reveal a venting aperture. The venting aperture container can be used to provide additional air to the pouring aperture, or can itself be used as a pouring aperture. Also disclosed is a venting scored portion and venting tab, located on the container bottom, serving the same purpose as the venting aperture located on the container side wall.

4 Claims, 6 Drawing Sheets

BEVERAGE CONTAINER AND OPENING MEANS

BACKGROUND OF THE INVENTION

1. Field of the Invention

The present invention relates generally to beverage containers and, more particularly, to a dual aperture beverage container.

2. Description of the Related Art

Single opening beverage cans utilize a single large hole for venting the liquid to be dispensed, be it beer or carbonated beverages. The problem with such a single aperture beverage can is that the flow of liquid is limited by flow friction caused by an inadequate air supply, especially when the container is in the pouring position. The usual, small, elliptical openings give a surging or restricted flow, since the outside air which needs to enter the container during the outward flow of beverage competes for the small space provided by the single opening. Also, the release of carbonation is extensive, resulting in a foam head on the liquid.

In order to facilitate a more controlled, efficient, even flow rate, a second aperture is desired. This is especially advantageous for the beverages that are carbonated or malt beverages, such as beer. By controlling the flow rate of direct consumption, the user can control the pour rate and resulting foam head. This reduction in foam head is desirable, since most people do not enjoy waiting for the foam head to subside before continuing pouring of the drink. Also, the reduction of the foam head reduces spillage from the overflow of the foam head. In effect, the second opening allows the user to pour the carbonated or malt beverage quickly from the container without the resulting foam.

A can with both a pouring aperture and a venting aperture in the exterior surface of the can is a valuable combination. This foam reduction and speed of consumption cause by the increased venting and air flow is desirable for those individuals who wish to drink their carbonated or malt beverages quickly without consuming the large foam head, from traditional beverage containers, and the resulting feeling of bloating and upset stomach.

This desire to consume beverages quickly occurs in several situations, such as during outdoor activities in the heat of summer, where people are hot and wish to consume refreshing beverages quickly, or during festive occasions, such as parties.

In the related art, numerous devices are disclosed which attempt to address this venting problem. Generally, these devices provide for two openings on the top of the can, one for pouring and one for venting. These devices include U.S. Pat. No. 5,494,184, issued in the name of Noguchi et. al., U.S. Pat. No. 5,397,014, issued in the name of Aydt, U.S. Pat. No. 5,285,919, issued in the name of Recchia, U.S. Pat. No. 5,011,037, issued in the name of Moen et. al., U.S. Pat. No. 4,872,597, issued in the name of Hanafusa, U.S. Pat. No. 4,576,306, issued in the name of Kelsey et al., U.S. Pat. No. 3,970,212, issued in the name of Brown, U.S. Pat. No. 3,662,914, issued in the name of Slade, and U.S. Pat. No. 3,627,168, issued in the name of Fraze.

A search of the prior art did not disclose any patents that read directly on the claims of the instant invention.

Consequently, a need has been felt for providing an improved, dual aperture beverage container that is novel in design, combining existing art with a new, second aperture for venting with a novel, new opening means, thereby creating a new and unique combination of technology.

SUMMARY OF THE INVENTION

It is therefore an object of the present invention to provide an improved, dual aperture beverage container that is novel in design, and which facilitates the quick, efficient and controlled dispensing of carbonated and malt beverages in a novel, fun and festive manner, and has a new, unique second aperture for venting along with a novel opening means of the venting aperture.

Briefly described according to one embodiment of the present invention, the dual aperture beverage container consists of a beverage container of traditional cylindrical shape, with a traditional pouring aperture assembly on the top of the container, such as a scored section and a tab. Located along the side wall of the container is a second scored section. A venting aperture opener is included which hooks onto the top rim of the container and opens the venting aperture. The venting aperture can be used to provide additional air to the pouring aperture, or can itself be used as a pouring aperture. Also disclosed is a venting scored portion and venting tab, located on the bottom of the container, serving the same purpose as the venting aperture on the side of the container.

It is another object of the present invention to provide for a second aperture used for venting located on the side wall of the can.

It is another object of the present invention to provide a novel opening means for the venting aperture.

It is another object of the present invention to provide for two apertures, each of which can be used either as a venting or pouring aperture.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Descriptive key

Figure 1:
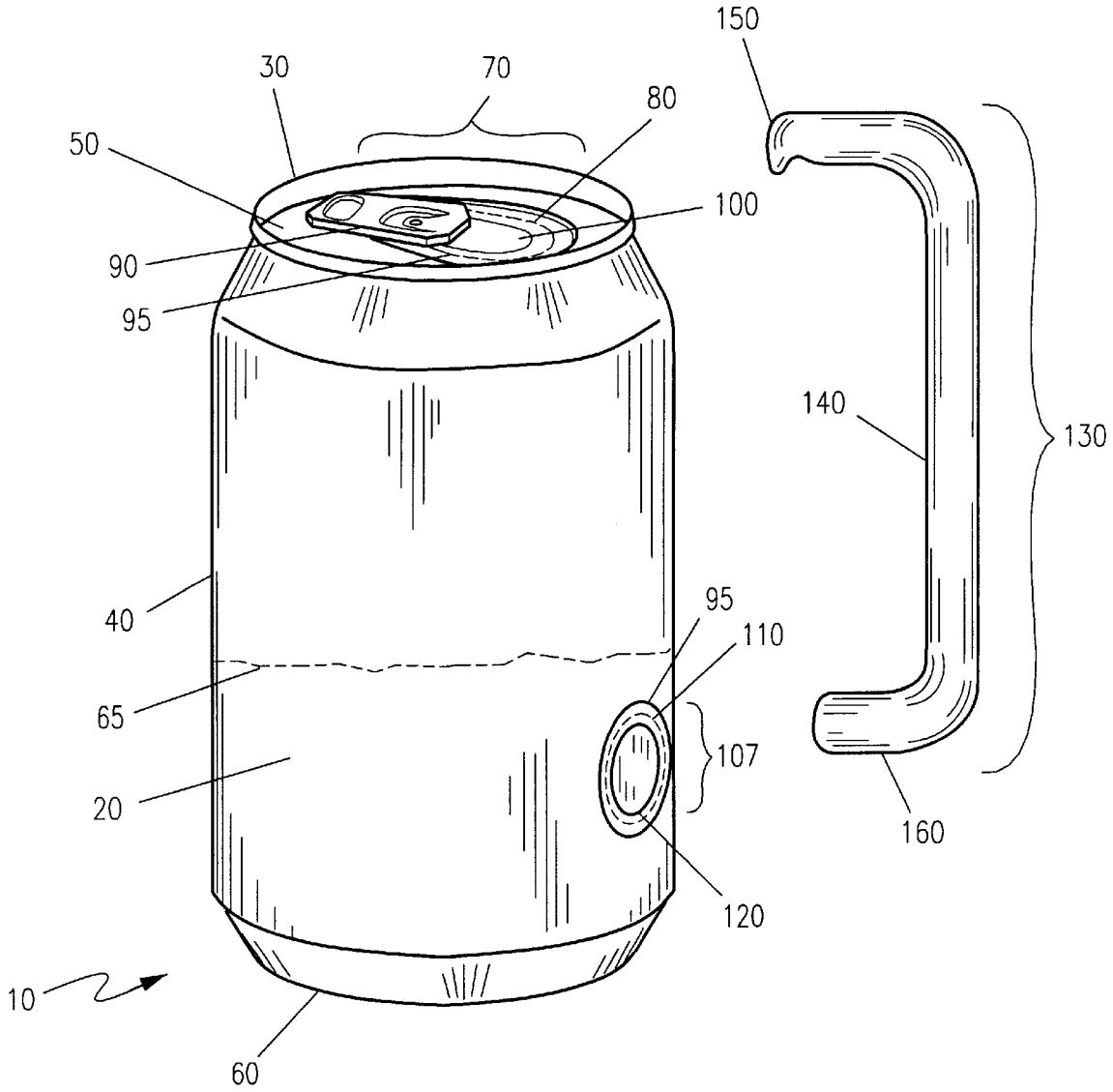
FIG. 1 is a front perspective view of the preferred embodiment of a dual aperture beverage container 10.

10 dual aperture beverage container
20 container
30 container rim
40 container side wall
50 container top
60 container bottom
65 liquid
70 pouring assembly
80 pouring scored portion
90 pouring tab

95 scoring
100 pouring aperture
107 venting aperture assembly
110 venting aperture
120 venting scored portion
130 venting aperture opening means
140 main shaft
150 rim attachment means
160 venting aperture opening protrusion
165 container package
170 venting tab
175 glass

DESCRIPTION OF THE PREFERRED EMBODIMENTS

In order to describe the complete relationship of the invention, it is essential that some description be given to the manner and practice of functional utility and description of a dual aperture beverage container.

The best mode for carrying out the invention is presented in terms of its preferred embodiment, herein depicted within the FIGS. 1–5.

1. Detailed Description of the Figures

Referring now to FIG. 1, a dual aperture beverage container 10 is shown, according to the present invention, comprising a container 20 of traditional cylindrical configuration, constructed from metal, and used to hold carbonated and malt beverages. The container 20 consists of a container rim 30, container side walls 40, a container top 50 and a container bottom 60, as found in traditional beverage containers 20 of this sort. The container 20 is capable of holding a specified quantity of liquid 65.

Figure 2:
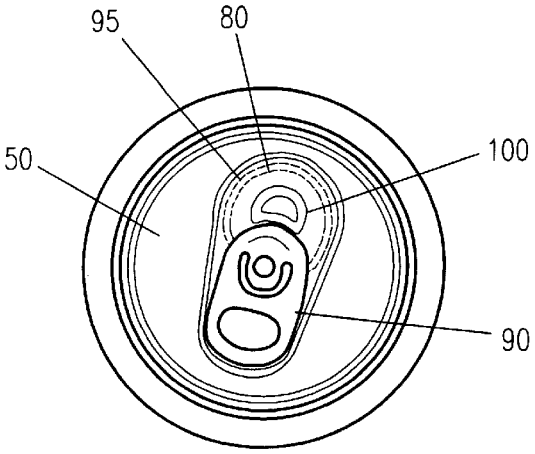
FIG. 2 is a top perspective thereof.

Referring now to FIG. 2, located along the container top 50 is a traditional beverage pouring assembly 70, including an elliptical pouring scored portion 80 with a pouring tab 90 attached to the container top 50 near the scoring 95 of the pouring scored portion 80 such that the pouring tab 90 acts as a fulcrum to open the pouring aperture 100.

Figure 3:
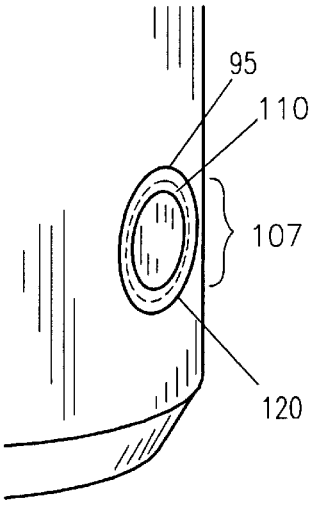
FIG. 3 is an enlarged view of the venting aperture.

Referring now to FIG. 3, located on the container side wall 40 is a venting aperture assembly 107. The venting aperture assembly 107 consists of a venting aperture 110. The venting aperture 110 is of generally cylindrical shape and of cross sectional diameter less than an average person's thumb, or ⅝ of an inch. The venting aperture 110 is covered by a venting scored portion 120. The venting scored portion 120 is bounded on all sides by scoring 95. The scoring 95 is of traditional size and spacing as used in the beverage container industry, so as to facilitate the pressurized detachment of the venting scored portion 120 from the surrounding container side wall 40, and into the container 20. The venting aperture assembly 107 is located on the lower portion of the container side wall 40, such that when the container 20 is inverted, air can enter the venting aperture 110 without liquid 65 flowing from the venting aperture 110.

Figure 4:
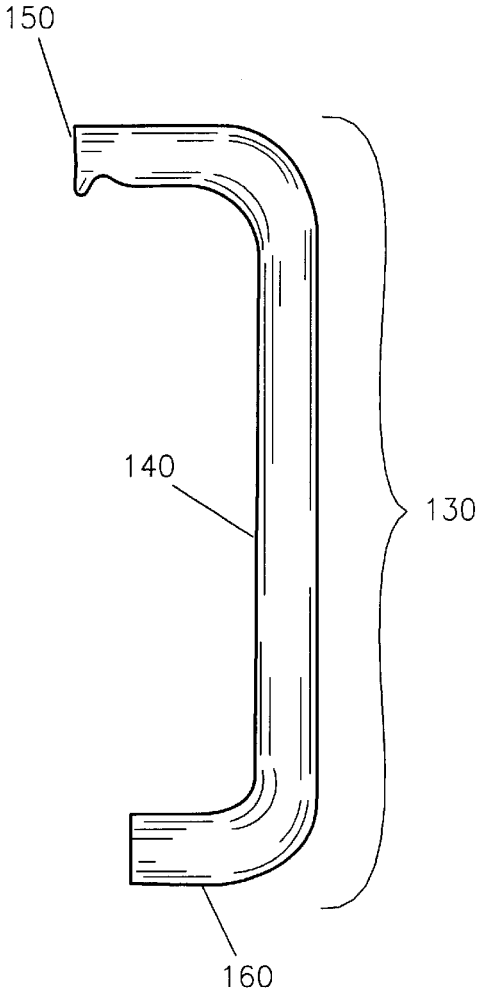
FIG. 4 is a front perspective view of the venting aperture opening means.

Referring now to FIG. 4, a venting aperture opening means 130 is included with the container 20, and is used to open the venting scored portion 120. The venting aperture opening means 130 consists of a main shaft 140. The main shaft 140 is a generally elongated, cylindrical, slightly curved shaft, constructed of a strong, lightweight material, such as plastic. One end of the main shaft 140 terminates in a rim attachment means 150. The rim attachment means 150 has a hook type configuration, consisting of an arc with a circumference spanning 180 degrees. The rim attachment means 150 is used to attach the venting aperture opening means 130 to the container rim 30, allowing the venting aperture opening means 130 to pivot on the container rim 30.

The other end of the main shaft 140, opposite the rim attachment means 150, terminates in a venting aperture opening protrusion 160. The venting aperture opening protrusion 160 is a cylindrical, linear shaft, extending outward, perpendicular to the centerline of the venting aperture opening means 130, parallel to the rim attachment means 150, and extending outward in the same horizontal direction as the rim attachment means 150. The venting aperture opening protrusion 160 terminates in a flat, circular surface that is parallel to the centerline of the main shaft 140.

Figure 5:
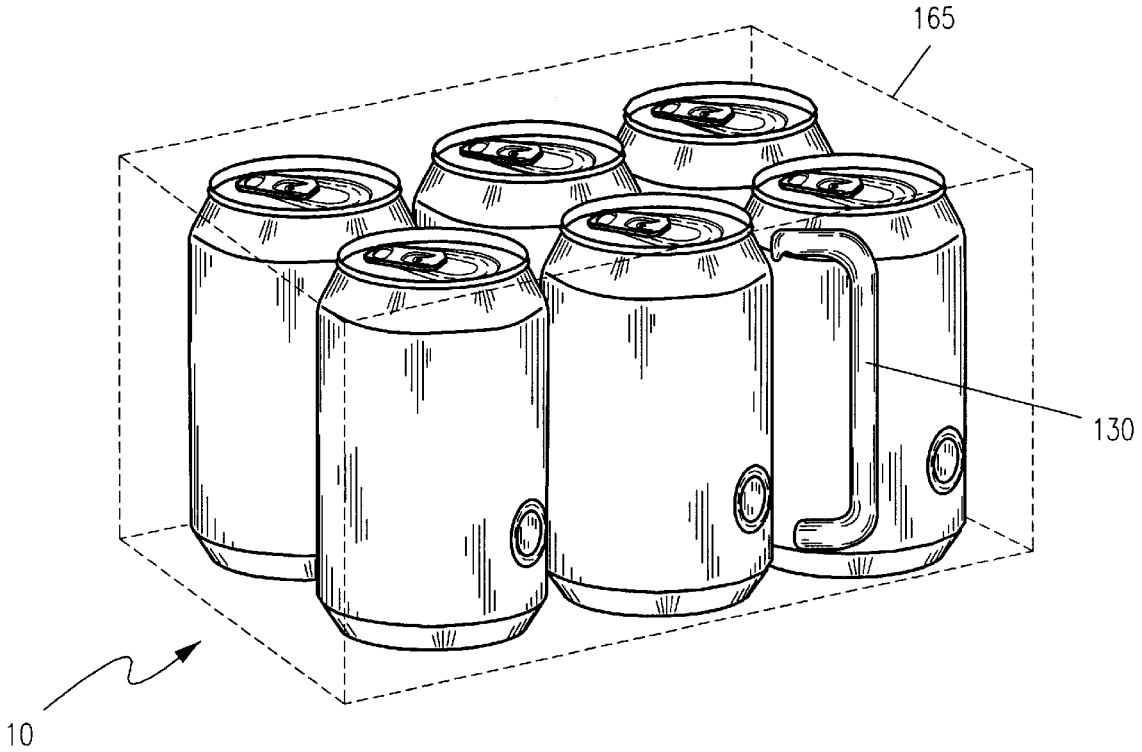
FIG. 5 is a front perspective view of a plurality of dual aperture beverage containers and a venting aperture opening means.

Referring now to FIG. 5, a plurality of dual aperture beverage containers 10 will be packaged together, in numbers such as six, twelve or twenty four, using traditional beverage container packaging technology. A venting aperture opening means 130 is included in the container package 165.

Figure 6A:
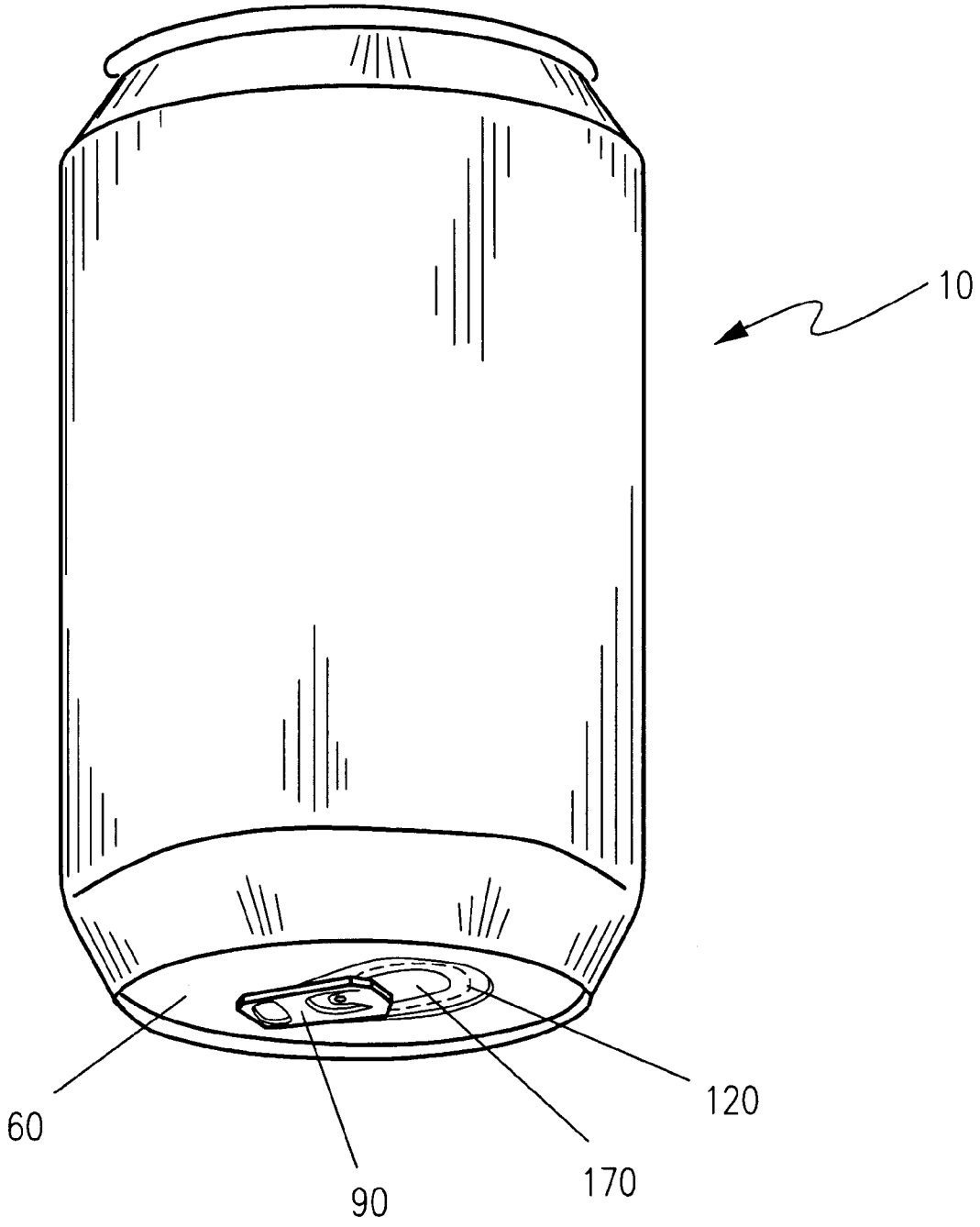
FIG. 6*a* is a bottom view of an alternate embodiment of the present invention.

Referring now to FIG. 6*a*, in an alternate embodiment, the venting scored portion 120 is located on the container bottom 60. A venting tab 170 of traditional design is also included and functions the same as the pouring tab 90 and pouring scored portion 80 on the container top 50.

Figure 6B:
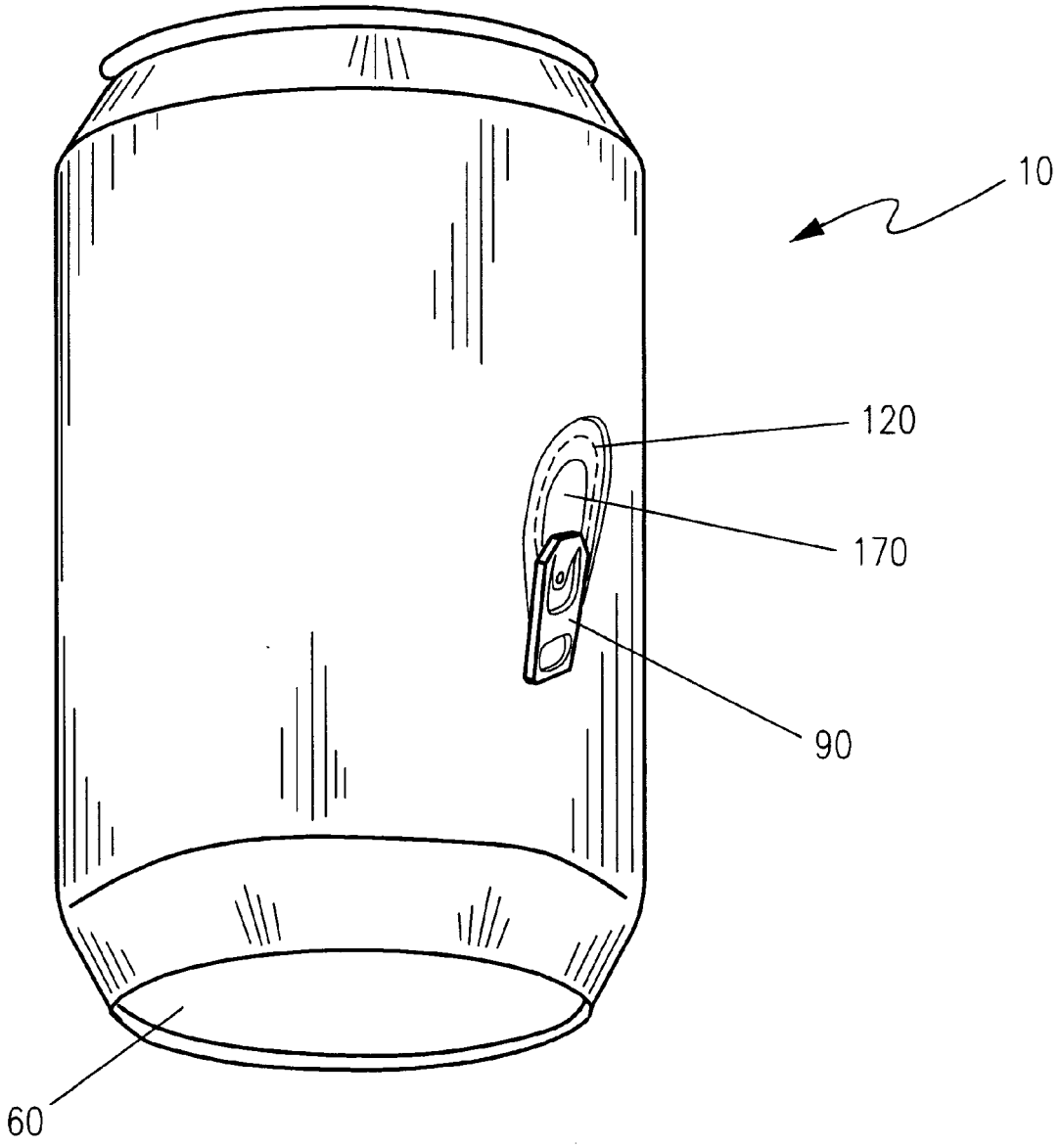
FIG. 6*b* is a side view of another alternate embodiment of the present invention.

Referring now to FIG. 6*b*, it is also envisioned that in an alternate embodiment, the venting scored portion 120 is located on the side wall 40. A venting tab 170 of traditional design is also included and functions the same as the pouring tab 90 and pouring scored portion 80 on the container top 50.

2. Operation of the Preferred Embodiment

Figure 7A:
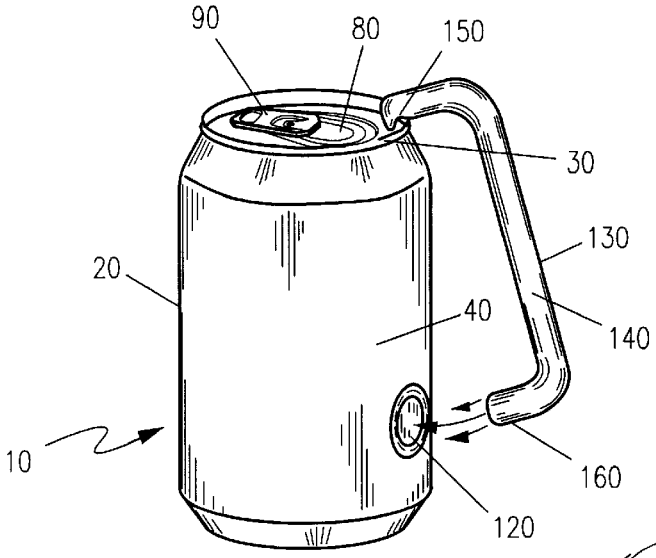
FIGS. 7*a*, 7*b* and 7*c* are as series of front perspective views showing the preferred embodiment in use.

Referring now to FIG. 7*a*, to use the present invention, the user opens the pouring scored portion 80 with the pouring tab 90. Then, the user places the venting aperture opening means 130 beside the container side wall 40, hooking the rim attachment means 150 over the container rim 30. The user then aligns the venting aperture opening protrusion 160 with the venting scored portion 120 and presses the main shaft 140 so as to force the venting aperture opening protrusion 160 against the venting scored portion 120, severing the scoring 95 from the container side wall 40 and pushing the venting scored portion 120 into the container 20, thus revealing the venting aperture 110. What the user does next depends upon whether the user wishes to use the venting aperture 110 as a venting means or as a pouring means.

Figure 7B:
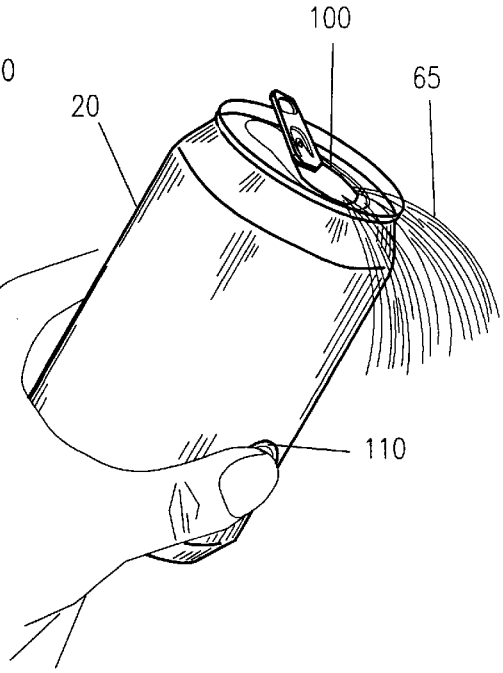

Referring now to FIG. 7*b*, if the user decides to use the venting aperture 110 as a venting means, the user immediately places his or her thumb over the venting aperture 110 and inverts the container 20, bringing the container 20 to his or her mouth. The user then releases his or her thumb from the venting aperture 110 and pours the liquid 65 beverage in the traditional fashion. The flow rate of the liquid 65 can be controlled by the amount of surface area of the venting aperture 110 which the user covers with his or her thumb.

Figure 7C:
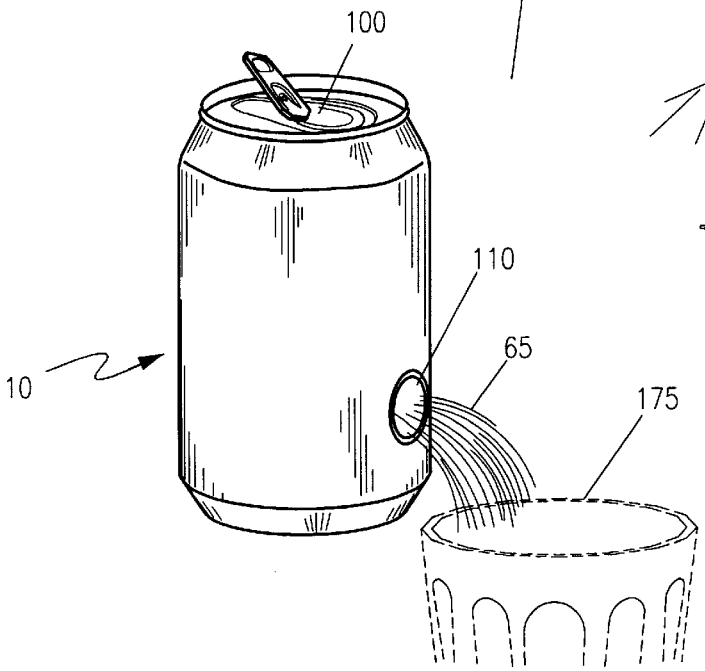

Referring now to FIG. 7*c*, if the user decides to use the venting aperture 110 as a pouring means, he or she simply places a glass 175 along side and below the venting aperture 110 and allows the liquid 65 to flow from the venting aperture 110, controlling the flow rate by covering the pouring aperture 100 with his or her thumb.

The foregoing description is included to illustrate the operation of the preferred embodiment and is not meant to limit the scope of the invention. The scope of the invention is to be limited only by the following claims.

What is claimed is:

1. A dual aperture beverage container and opening means comprising:

a container, said container being of cylindrical configuration, constructed from metal, and used to hold carbonated and malt beverages, said container further comprising a container top, a container bottom, a container side wall, a container rim, and a pouring aperture assembly located on said container top, which opens a pouring aperture from which liquids can be poured;

a vent aperture assembly, said vent aperture assembly being located on said container side wall, and used to provide a venting means for said liquids in said container;

a venting aperture opening means, said venting aperture opening means being used to open said venting scored portion, wherein said venting aperture opening means further comprises:

a main shaft, said main shaft having two ends and being an elongated, cylindrical, slightly curved shaft, constructed of plastic;

a rim attachment means, said rim attachment means being located on one end of said main shaft, said rim attachment means having a hook type configuration, consisting of an arc with circumference spanning 180 degrees, said rim attachment means being used to attach said venting aperture opening means to said container rim, allowing said venting aperture opening means to pivot on said container rim;

a venting aperture opening protrusion, said venting aperture opening protrusion being located on the other end of said main shaft, opposite said rim attachment means, said venting aperture opening protrusion being a cylindrical, linear shaft, extending outward, perpendicular to the centerline of said venting aperture opening means, parallel to said rim attachment means, and extending outward in the same horizontal direction as said rim attachment means, with said venting aperture opening protrusion terminating in a flat, circular surface that is parallel to the centerline of said main shaft.

2. The dual aperture beverage container described in claim 1, wherein said venting aperture assembly further comprises:

a venting aperture, said venting aperture being of a cylindrical shape and of cross sectional diameter less than ⅝ of an inch;

a venting scored portion, said venting scored portion covering said venting aperture;

scoring, said scoring completely surrounding said venting scored portion, said scoring being spacing so as to facilitate the pressurized detachment of said venting scored portion from the surrounding container side wall, and into said container.

3. The venting aperture assembly described in claim 2, wherein said venting aperture is located on the lower portion of said container side wall, such that when said container is inverted, air can enter said venting aperture without liquid flowing from said venting aperture.

4. The dual aperture beverage container described in claim 1, wherein said containers are packaged in units of six, using conventional beverage packaging technology, along with one said venting aperture opening means.

* * * * *